US005692921A

United States Patent [19]

Jennings

[11] Patent Number: 5,692,921

[45] Date of Patent: Dec. 2, 1997

[54] ELECTRICAL LOCKING SOCKET AND MULTIPLE POSITION SWIVEL PLUG

[76] Inventor: Michael Jennings, R.R. #1, Box 20, South Ryegate, Vt. 05069

[21] Appl. No.: 698,031

[22] Filed: Aug. 15, 1996

[51] Int. Cl.[6] ..... H01R 4/50

[52] U.S. Cl. ..... 439/346; 439/31; 439/173

[58] Field of Search ..... 439/346–349, 439/372, 31, 173, 640

[56] References Cited

U.S. PATENT DOCUMENTS

| | | | |
|---|---|---|---|
| 2,732,531 | 1/1956 | Janowiec | 439/346 |
| 3,543,218 | 11/1970 | Archer | 439/345 |
| 3,691,327 | 9/1972 | Chesler | 439/346 |
| 4,061,409 | 12/1977 | Bealmear | 439/346 |
| 4,085,991 | 4/1978 | Marshall et al. | 439/346 |
| 4,784,611 | 11/1988 | Poulin et al. | 439/346 |
| 4,865,553 | 9/1989 | Tahigawa et al. | 439/31 |
| 4,909,749 | 3/1990 | Long | 439/346 |
| 5,249,970 | 10/1993 | Jennings | 439/31 |
| 5,352,132 | 10/1994 | O'Keefe et al. | 439/346 |
| 5,551,884 | 9/1996 | Burkhart, Sr. | 439/346 |

*Primary Examiner*—Hien Vu

*Attorney, Agent, or Firm*—Brady, O'Boyle & Gates

[57] ABSTRACT

An electrical locking socket and multiple position swivel plug in which the socket has gripping members for holding the blades of a plug inserted into the socket, and the swivel plug is pivotally connected to the socket and latched at a desired angular position relative to the socket. These features prevent the inadvertent separation of socket and plug assemblies.

7 Claims, 3 Drawing Sheets

ELECTRICAL LOCKING SOCKET AND MULTIPLE POSITION SWIVEL PLUG

BACKGROUND OF THE INVENTION

In applicant's U.S. Pat. No. 5,249,970 dated Oct. 5, 1993, there is disclosed a multiple position electrical swivel plug apparatus constructed and arranged to prevent interconnected plug assemblies from separating when a pulling force is applied to the electrical cord to which the plug apparatus is attached. This is accomplished by a locking cap in each plug assembly for holding the respective plug assembly in a desired angle position relative to the other interconnected plug assembly.

While the swivel plug apparatus disclosed in the above-noted patent has been satisfactory for its intended purpose, in his continuing research and development in the area of electrical plug assemblies, applicant has now devised an improved locking arrangement to prevent the inadvertent disconnection of plug assemblies, and also a slide lock for holding the plug assemblies in a desired angle position.

SUMMARY OF THE INVENTION

The electrical locking socket and multiple position swivel plug of the present invention comprises, essentially, a housing having a closed end and an open end to thereby provide a socket, and spaced, parallel longitudinally extending contact blades fixedly mounted in the housing. A longitudinally extending split block is positioned in the space between the blades, and the block is formed with a first pair of longitudinal leg members which extend in a direction toward the closed end of the housing, and a second pair of leg members, which extend in a direction toward the open end of the housing. A transversely extending web member is integral with both pairs of leg members substantially intermediate the ends thereof. A transversely extending bolt extends through the first pair of leg members and is adapted to squeeze the first pair of leg members together to thereby spread the second pair of leg members in an opposite direction, whereby the blades of a plug inserted into the open end of the housing and positioned between the second pair of leg members, and the electrical contact blades are gripped between the second pair of leg members and contact blades, to thereby lock the plug into electrical contact with the socket. To further enhance the locking feature of the socket, the outwardly facing surfaces of the second pair of leg members are serrated, and a pair of oppositely facing dimples or protrusions are integral with the second pair of leg members adapted to be received in the holes normally provided in plug blades.

The closed end of the housing can have either an electrical conductor or cord extend therethrough and electrically connected to the fixed electrical contact blades in the housing, or a swivel plug assembly pivotally connected to the fixed electrical contact blades. A slide lock mechanism is operatively connected between the socket housing and the swivel plug assembly, whereby the swivel plug assembly can be maintained at a desired angular position relative to the socket.

DESCRIPTION OF THE PREFERRED EMBODIMENTS

Figure 1:
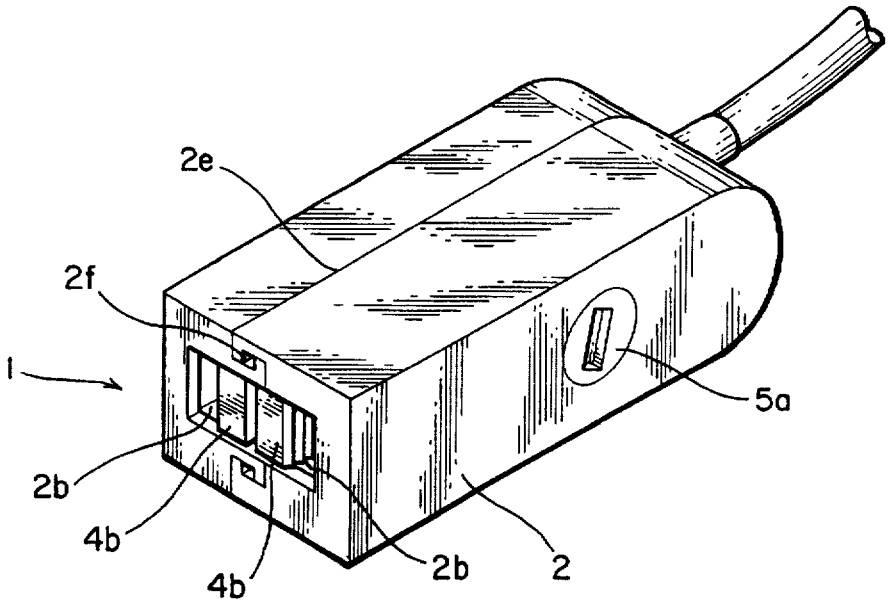
FIG. 1 is a perspective view of the locking socket of the present invention.
Figure 2:
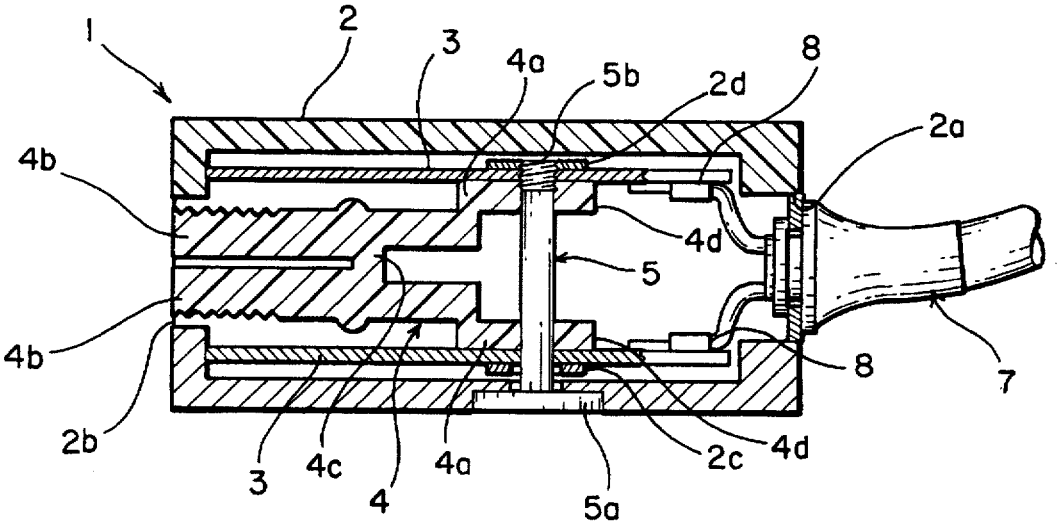
FIG. 2 is a top plan view, partially in section, of the locking socket shown in FIG. 1.

Referring to the drawings and, more particularly to FIGS. 1 and 2, the locking socket 1 of the present invention comprises a housing 2 having a closed end 2*a* and an open end 2*b*. Spaced, parallel, longitudinally extending contact blades 3 are fixedly mounted in the housing 2 by insulation members 2*c* and 2*d* integral with the housing 2. A longitudinally extending split plastic block 4 is positioned in the space between the contact blades 5, and the block is formed with a first pair of longitudinal leg members 4*a* which extend in a direction toward the closed end 2*a* of the housing 2, and a second pair of leg members 4*b* which extend in a direction toward the open end 2*b* of the housing 2. A transversely extending web member 4*c* is integral with both pairs of leg members 4*a* and 4*b*. The free end portions of the leg members 4*a* have integral ear members 4*d* through which a transverse bolt 5 extends. The bolt 5 is provided with a slotted head portion 5*a* which lies flush with the side wall of the housing 2, and a threaded portion 5*b* which is threadably received in the insulation member 2*d*.

Figure 3:
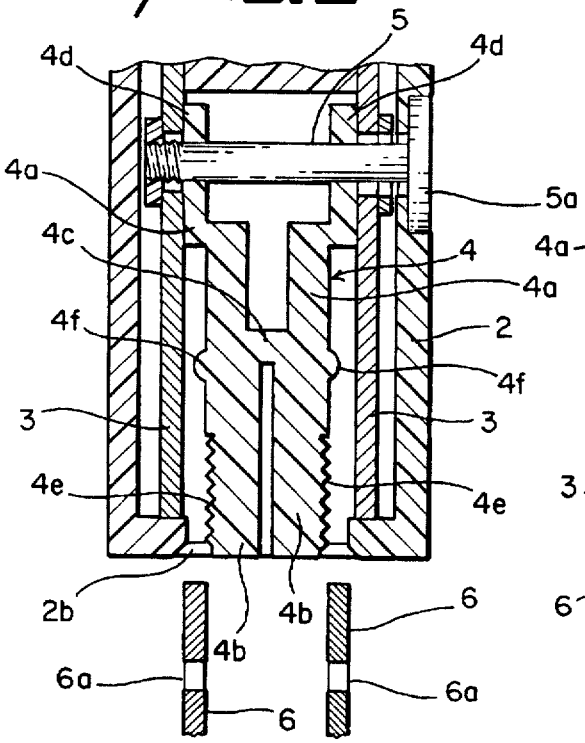
FIG. 3 is an enlarged, fragmentary top plan view, partially in section, showing the locking socket in the open or released position for receiving the prongs of a plug.
Figure 4:
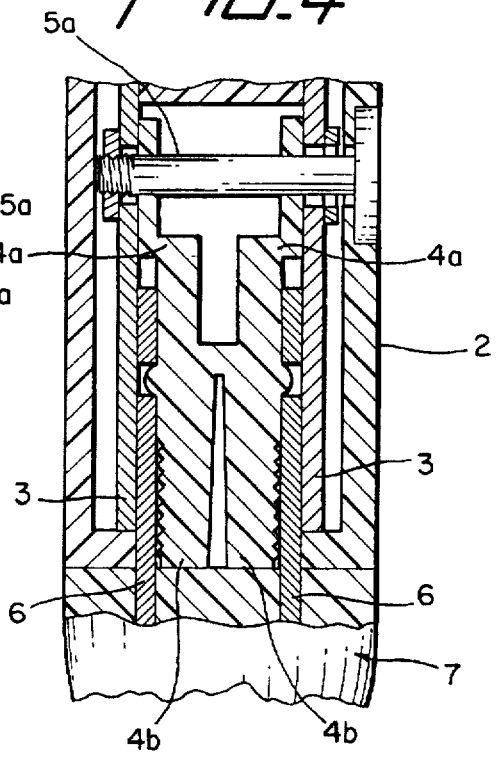
FIG. 4 is an enlarged, fragmentary, top plan view, partially in section, showing the locking socket in the closed or clamping position grasping the prongs of the plug.

By threading the bolt 5 into the housing 2, the leg members 4*a* are squeezed together, as shown in FIG. 4, to thereby spread the second pair of leg members 4*b* in an opposite direction toward the contact blades 3. By this construction and arrangement, as shown in FIGS. 3 and 4, when the blades 6 of a plug 7 are inserted into the open end 2*b* of the housing 2 and positioned between the leg members 4*b* and the electrical contact blades 3, the plug blades 6 are gripped between the leg members 4*b* and contact blades 3, to thereby lock the plug 7 into electrical contact with the socket 2.

To further enhance the locking feature of the socket 2, the outwardly facing surfaces of the leg members 4*b* are provided with serrations 4*e*, and a pair of oppositely facing protrusions or dimples 4*f* integral with the leg members 4*b* and receivable in the holes 6*a* normally provided in the plug blades 6.

As will be seen in FIG. 1, the housing is split as at 2*e* to provide a clearance 2*f* to allow for the compression and expansion of the housing during the turning of the bolt 5.

Figure 8:
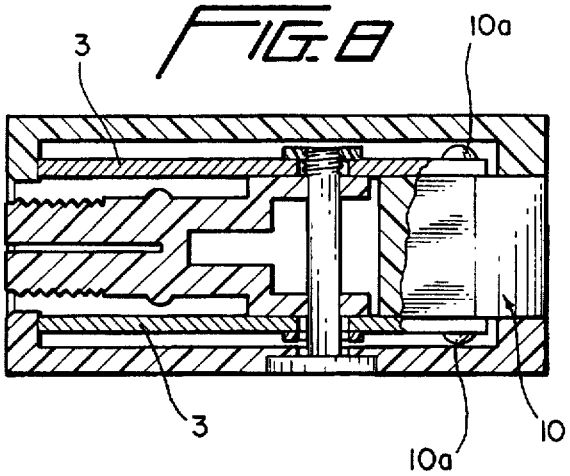
FIG. 8 is a top plan view, partially in section, of the locking socket and swivel plug shown in FIG. 7.
Figure 9:
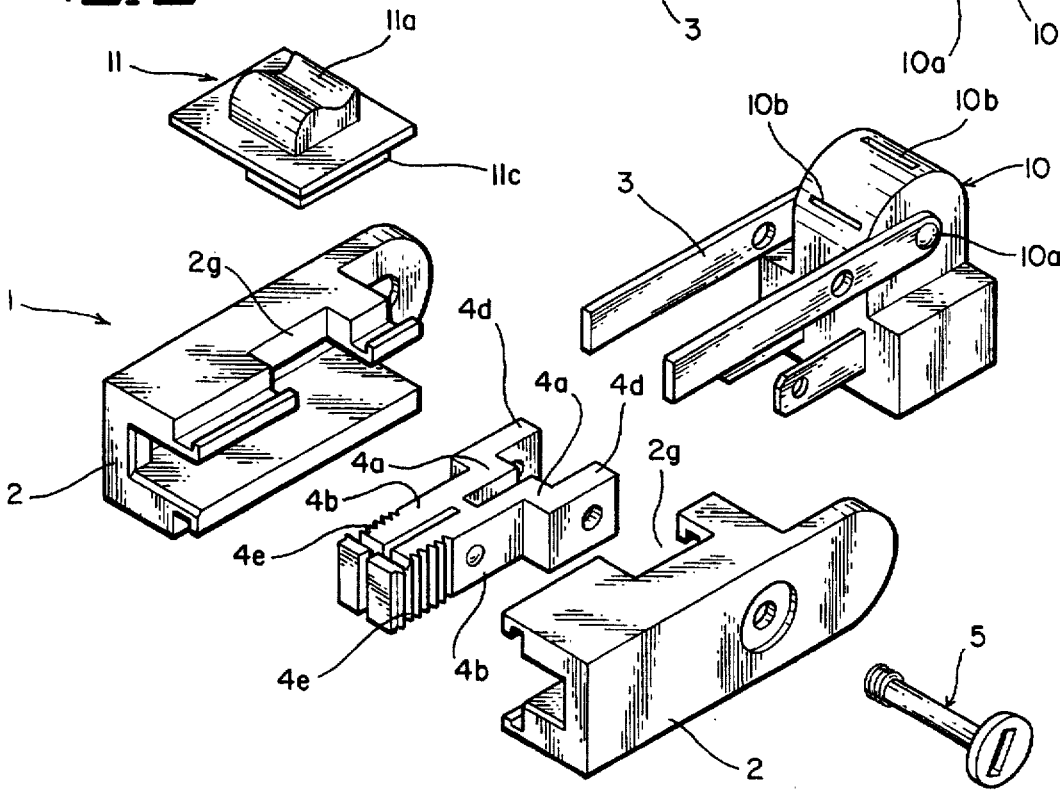
FIG. 9 is an exploded, perspective view of the locking socket and swivel plug shown in FIGS. 7 and 8.

The closed end 2*a* of the socket housing 2, as shown in FIG. 2, have either an electrical conductor or cord 7 extend therethrough and electrically connected as at 8 to the fixed electrical contact blades 3, or, as shown in FIGS. 8 and 9, the housing 2 can be closed by a plug assembly 10 electrically and pivotally connected to the contact blades 3 as at 10*a*.

Figure 5:
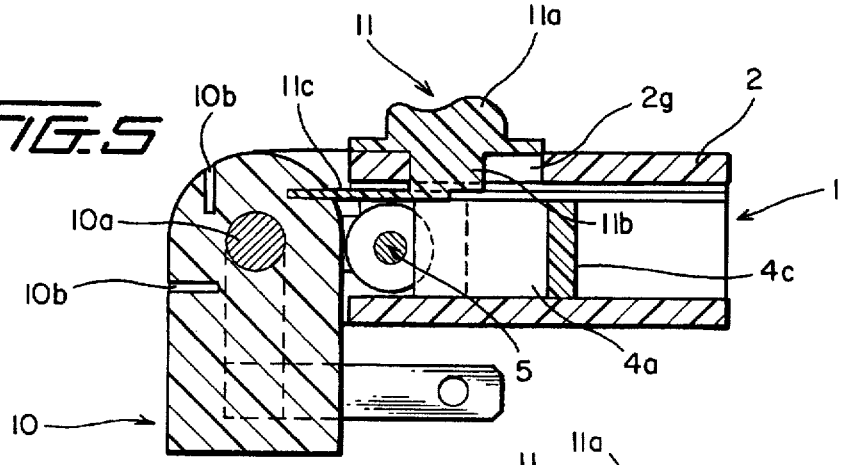
FIG. 5 is a side elevational view, partially in section, showing the swivel plug latched in a desired angular position relative to the socket.
Figure 6:
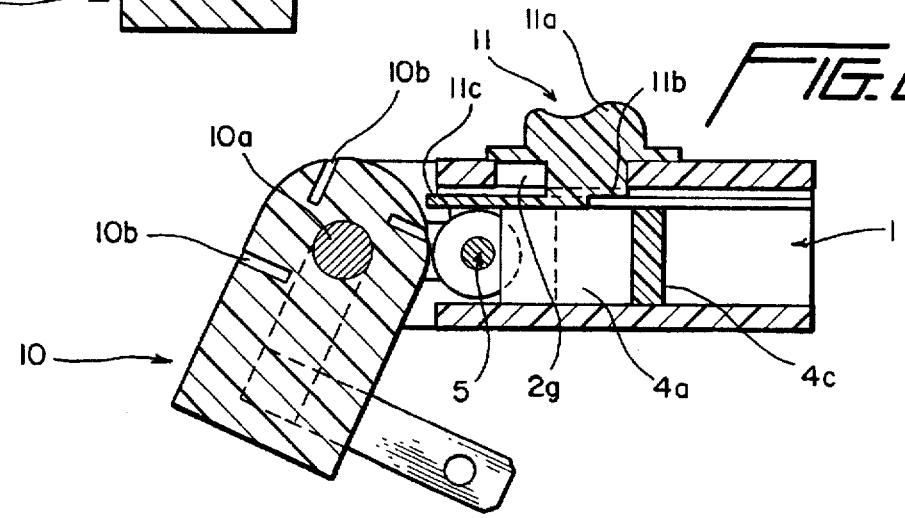
FIG. 6 is a side elevational view, partially in section, showing the swivel plug in the released position.
Figure 7:
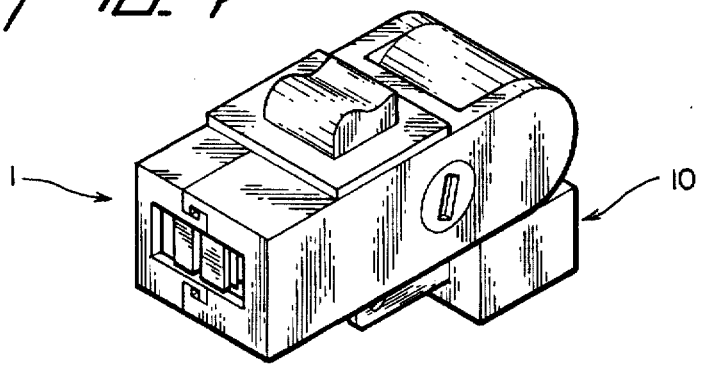
FIG. 7 is a perspective view of the locking socket shown in FIG. 1 having the swivel plug of FIG. 5 connected thereto.

As will be seen in FIGS. 5, 6, and 9, a slide lock mechanism or latch assembly 11 is provided for maintaining the plug assembly 10 at a desired angular position relative to the socket 1. The latch assembly 11 comprises a thumb portion 11*a* slidably mounted on the top surface of the housing 2. The thumb portion 11*a* has a depending portion 11*b* extending through an opening 2*g* in the top wall of the housing 2 and integral with a horizontally extending finger 11*c* slidably mounted on the upper surface of the leg members 4*a*. A plurality of slots 10*b* are provided in the plug housing adapted to receive the latch finger 11*c*. By this construction and arrangement when the latch assembly 11 is in the retracted position as shown in FIG. 6, the plug assembly 10 is freely pivotal about the pivot pin 10*a*. To fix the plug assembly 10 at a desired angular position relative to the socket 1, a selected slot 10*b* in the plug housing is aligned with the finger 11*c* of the latch assembly 11 which is then manually moved to the extended position; as shown in FIG. 5, to insert the finger 11*c* into the slot 10*b*.

From the above description, it will be readily apparent to those skilled in the art that the electrical locking socket and multiple position swivel plug of the present invention provides an improved locking socket for holding the blades of a plug insert therein, and an improved latch assembly for holding the swivel plug assembly at a desired position, whereby inadvertent separation of the socket and plug assemblies is prevented.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. An electrical locking socket comprising a housing having an open end and a closed end, a pair of spaced, parallel, longitudinally extending contact blades fixedly mounted in said housing, a longitudinally extending insulative split block positioned in between said pair of spaced contact blades, said block having a first and second pair of longitudinally extending leg members, said first pair of leg members extending in a direction toward the closed end of the housing, said second pair of leg members extending in a direction toward the open end of said housing, a transversely extending web member integrally formed with both pairs of leg members substantially intermediate the ends thereof, and a transverse bolt having threads extending into said housing and through said first pair of leg members adapted to squeeze said first pair of leg members together, to thereby spread the second pair of leg members outwardly, whereby blades of an electrical plug inserted into the open end of the housing and positioned between the second pair of leg members, and the plug blades are gripped by teeth means between the second pair of leg members and the pair of spaced contact blades of said socket respectively, to thereby lock the plug into electrical contact with the socket.

2. The socket according to claim 1, wherein the second pair of leg members have outwardly facing surfaces, said outwardly facing surfaces being serrated to provide teeth to thereby enhance the gripping of the plug blades.

3. The socket according to claim 2, wherein holes are provided in the plug blades, and dimples are provided on the outwardly facing surfaces of the second leg members adapted to be received in the plug blade holes.

4. The socket according to claim 1, wherein an electrical cord extends through the closed end of the housing, said cord being electrically connected to the fixed electrical contact blades in the housing.

5. The socket according to claim 1, wherein the end of the housing is closed by a swivel plug assembly pivotally connected to the fixed electrical contact blades.

6. The socket according to claim 5, wherein a latch assembly is operatively connected between the socket housing and the swivel plug assembly, whereby the swivel plug assembly can be maintained at a desired angular position relative to the socket.

7. The socket according to claim 6, wherein the latch assembly comprises an opening provided in a top wall of the socket housing, a thumb portion slidably mounted on a top surface of the top wall of said socket housing, a depending portion integral with said thumb portion extending through said opening, a horizontally extending finger integral with said depending portion, said swivel plug including a housing, and a plurality of slots provided in said plug housing adapted to selectively receive said finger to thereby latch the swivel plug at a desired angular position relative to the socket.

* * * * *